US008230620B2

(12) United States Patent
Ebel

(10) Patent No.: US 8,230,620 B2
(45) Date of Patent: Jul. 31, 2012

(54) FOOT PAD FOR RELIEVING PAIN

(76) Inventor: Brian Ebel, Towson, MD (US)

( * ) Notice: Subject to any disclaimer, the term of this patent is extended or adjusted under 35 U.S.C. 154(b) by 645 days.

(21) Appl. No.: 12/379,690

(22) Filed: Feb. 26, 2009

(65) Prior Publication Data

US 2010/0212189 A1 Aug. 26, 2010

(51) Int. Cl.
*A43B 7/14* (2006.01)

(52) U.S. Cl. ..... 36/91; 36/145; 36/173

(58) Field of Classification Search ..... 36/91, 145, 36/173, 92, 37, 43, 44, 71, 80, 143, 144, 36/166

See application file for complete search history.

(56) References Cited

U.S. PATENT DOCUMENTS

| | | | | | |
|---|---|---|---|---|---|
| 879,527 | A | | 2/1908 | Dorrity | |
| 1,575,490 | A | * | 3/1926 | Krech | 36/160 |
| 1,628,161 | A | * | 5/1927 | Le Boeuf | 36/173 |
| 1,733,678 | A | | 10/1929 | Torchia | |
| 1,768,648 | A | * | 7/1930 | Welch | 36/174 |
| 1,926,033 | A | | 9/1933 | Bynum | |
| 1,976,441 | A | * | 10/1934 | Feldman | 36/173 |
| 2,055,399 | A | | 9/1936 | Ahern | |
| 2,073,775 | A | * | 3/1937 | Baumel | 36/80 |
| 2,086,242 | A | * | 7/1937 | Sheridan | 36/80 |
| 2,089,344 | A | * | 8/1937 | Crull | 36/80 |
| 2,170,737 | A | | 8/1939 | Swant | |
| 2,255,100 | A | * | 9/1941 | Brady | 36/173 |
| 2,335,187 | A | * | 11/1943 | Keil | 36/173 |
| 2,434,258 | A | | 1/1948 | Burns | |
| 2,505,508 | A | | 4/1950 | Shapiro | |
| 2,814,133 | A | * | 11/1957 | Herbst | 36/80 |
| 3,094,985 | A | | 6/1963 | Kendall | |
| 3,257,742 | A | | 6/1966 | Feinberg | |
| 4,726,127 | A | | 2/1988 | Barouk | |
| 4,841,648 | A | * | 6/1989 | Shaffer et al. | 36/43 |

(Continued)

OTHER PUBLICATIONS

Bolga, L.A. et al., *Plantar Fasciitis and the Windlass Mechanism: A Biomechnical Link to Clinical Practice*, Journal of Athletic Training, Jan.-Mar. 2004, pp. 1-10 (citing and exemplifying pp. 77-82), v.39(1), National Athletic Trainers Association, Inc.

(Continued)

*Primary Examiner* — Ted Kavanaugh
(74) *Attorney, Agent, or Firm* — Roylance, Abrams, Berdo & Goodman, L.L.P.

(57) ABSTRACT

A foot pad for relieving pain while engaging in weight bearing activity is provided. A pad can include an arch portion fitting under and adjacent to the medial longitudinal arch of the foot, offsetting the soft tissue of the medial longitudinal arch thereby supporting the calcaneo-navicular ligament structure, wherein the arch portion extends from front to rear, of the longitudinal medial arch, and the arch portion extends from the medial side towards the lateral side, of the longitudinal medial arch. Furthermore, the pad can provide a heel portion of the pad fitting under the heel of the foot, the heel portion connecting a medial side portion of the pad to a lateral side portion of the pad, cushioning and reduces soreness and pressure from the sole of the foot by offsetting the soft tissue of the medial longitudinal arch, thereby supporting the calcaneo-navicular ligament structure reducing over-pronation and increasing supination of the foot during weight bearing activity, offsetting and cushioning the soft tissue of the outer portions of sole of the heel and offsetting the central portion of the heel from the surface immediately below the pad at a distance of approximately the thickness of the pad, during weight bearing activity.

7 Claims, 11 Drawing Sheets

U.S. PATENT DOCUMENTS

| | | | | |
|---|---|---|---|---|
| 5,092,347 | A | 3/1992 | Shaffer et al. | |
| 5,539,020 | A | 7/1996 | Bracken et al. | |
| 5,611,153 | A | 3/1997 | Fisher et al. | |
| 5,645,525 | A | 7/1997 | Krivosha | |
| 6,141,890 | A | 11/2000 | Chtn | |
| 6,187,837 | B1 | 2/2001 | Pearce | |
| 6,453,578 | B1 | 9/2002 | Yung et al. | |
| 7,041,075 | B2 * | 5/2006 | Sullivan | 602/23 |
| 7,056,299 | B2 | 6/2006 | Brown et al. | |
| 2002/0094959 | A1 | 7/2002 | DesRosiers | |
| 2002/0162250 | A1 | 11/2002 | Campbell et al. | |
| 2003/0061733 | A1 | 4/2003 | Karsten | |
| 2004/0103561 | A1 | 6/2004 | Campbell et al. | |
| 2005/0131324 | A1 | 6/2005 | Bledsoe | |
| 2006/0058722 | A1 | 3/2006 | Brown | |
| 2006/0288613 | A1 | 12/2006 | Lo | |
| 2007/0028485 | A1 | 2/2007 | Crane et al. | |
| 2007/0124959 | A1 * | 6/2007 | Meffan | 36/28 |

OTHER PUBLICATIONS

Cornwall, Mark W., *Common Pathomechanics of the foot*, Athlete Therapy Today, 2000, pp. 10-16, v.5(1), Northern Arizona University.

Kwong. P.K. et al., *Plantar Fasciitis: Mechanics and Pathomechanics of Treatment*, Clinical Sports Medicine, 1988, p. 1 (Abstract citing and exemplifying pp. 119-126), v.7(1), PubMed.

* cited by examiner

FOOT PAD FOR RELIEVING PAIN

FIELD OF THE INVENTION

The present application relates to a foot pad for relieving pain while engaging in weight bearing activity.

BACKGROUND OF THE INVENTION

Generally, weight bearing activities (for example, standing, walking, running, etc.) can lead to various types of ailments. For example, commonly known types of foot ailments include plantar fasciitis and heel spurs, which are a common source of pain for many individuals.

According to FIG. 3, the plantar aspect relates to the sole of the foot 303 and the plantar fascia comprises a sheet of fibrous tissue beneath the skin 301 enclosing and separating several layers or groups of fibrous tissue. The plantar fascia 301 tissue supports the arch of the foot, running from the tuberosity of the calcaneus 307 forward to the heads of the metatarsal bones. The plantar fascia 301 contributes to support the arch of the foot when the foot bears weight. The plantar fascia 301 has a dynamic function during gait, elongating during the contact phase of gait, having rapid elongation before and immediately after mid-stance reaching maximum elongation between mid-stance and toe-off. The plantar fascia behaves like a spring during this phase, in addition to contributing to the windlass mechanism during normal mechanical function of the foot. The Windlass Mechanism is the coordinated action of the layers of muscle, tendon, ligament and bony architecture, to maintain arch height and foot rigidity. Without correct windlass function, the foot will not act as an efficient lever, and an effective push off power cannot be achieved.

The term fasciitis refers to a degenerative condition without histological evidence of chronic inflammation. People with plantar fasciitis may notice tenderness in the insertion of the plantar fascia into the calcaneus causing soreness and pressing downward, inward and forward of the inferior calcaneo-navicular ligament 302 (also known as spring ligament) by the weight of the body and the foot. Plantar fasciitis is an inflammation of the plantar fascia 301. Plantar fasciitis can result when the fascia swells and its fibers begin to fray. Other factors, for example etiologic factors can also relate to plantar fasciitis including overuse, increased body weight, hyper-pronation, etc.

The inferior calcaneonavicular ligament 302 (spring ligament) is a ligament on the underside of the foot that connects the calcaneus with the navicular bone, and supports the astragulus, maintaining the arch of the foot when it yields, the head of the astragulus is pressed downward, inward and forward by the weight of the body, causing the foot to become flattened, expanded and turned outward, causing pain to the bottom of the foot. This ligament 302 comprises elastic fiber to give elasticity to the arch and spring to the foot (thus, being known as the spring ligament). The calcaneo-navicular ligament 302 interacts with the medial longitudinal arch of the foot. This ligament 302 is supported on it's undersurface by the tendon of the tibialis posterior, which spreads out at its insertion into a number of fasciculi, which are attached to most of the tarsal and metatarsal bones. This presents undue stretching of the ligament and needs protection against problems such as flat foot, over-pronation, heel spur and foot fatigue.

Pronation is a rotational movement of the foot and refers to how the body distributes weight as it cycles through gait. Pronation depends on the extent to which the arch collapses when the foot goes through a walk/gait cycle. Pronation can also occur while an individual is standing. A foot can have three types of pronation: neutral pronation, underpronation and over-pronation. During over-pronation, an individual may initially strike the ground on the lateral side of the heel and as the individual transfers weight from the heel to the metatarsus, the foot will roll too far towards medial side of the foot, such that the weight is distributed unevenly across the metatarsus, perhaps tracking the knee inward. Over-pronation causes problems because it does not allow the foot to absorb shock efficiently. During over-pronation, the longitudinal medial arch will collapse and the ankle may roll inward as the individual proceeds through the gait cycle. For individuals with over-pronation, keeping the foot appropriately supinated becomes a problem during weight bearing activities, since the foot rolls too far towards the medial longitudinal arch, causing soreness and pain to the soft tissue near the arch as a result of weight bearing activities (in addition to other ailments). Over-pronation flattens the longitudinal medial arch as the foot strikes the ground.

Supination is the opposite of pronation and occurs when the person's weight is supported by the anterior of their feet.

Heel pain can result from various sources, including plantar fasciitis and heel spurs. A heel spur 307 is a bony outgrowth at the base of the heel bone near the plantar fascia 301 that can lead to pain on the bottom of the heel during weight bearing activities. Generally, heel spurs can form in some individuals who have plantar fasciitis, thus leading to pain stemming from plantar fasciitis and the heel spur. However, heel spurs can also occur independently in individuals with no symptoms of plantar fasciitis.

Other ailments that lead to foot pain include flatfoot, Achilles contracture tight heel cord, inflammatory arthopathies, obesity, knee pain, shin splints, Achilles tendonitis, posterior tibial tendonitis, fallen arches, metatarsalgia, low arches, fasciitis, stress fractures, hip pain, back pain, arch fatigue, cavus foot that results in contracture of plantar fascia and plantar soft tissue.

Various treatments and products have been developed to try to address foot pain. These treatments and procedures can be cumbersome, painful, expensive and ineffective for individuals suffering from foot pain. For example, foot pads, arch pads and heel pads developed prior to the embodiments of the present invention tend to be bulky, heavy, annoying and ineffective. Embodiments of the present invention overcome these, and other problems in the prior art.

SUMMARY OF THE INVENTION

Exemplary embodiments of the present invention address at least the above problems and/or disadvantages and provide at least the advantages described below. Accordingly, an object of exemplary embodiments of the present invention is to provide a convenient, simple and lightweight pad that cushions the portions of the foot and offsets areas of the sole of the foot that gets pressure from weight bearing activities, thereby helping take pressure off the sole of the foot, reducing soreness and pain.

An exemplary embodiment of the present invention provides a pad for relieving pain caused by over-pronation of the foot while engaging in weight bearing activity wherein the pad cushions, and reduces sores and pressure off the sole of the foot by offsetting the soft tissue of the medial longitudinal arch, thereby supporting the calcaneo-navicular ligament structure, reducing the over-pronation of the foot and increasing supination during weight bearing activity.

An exemplary embodiment of the present invention provides a pad for relieving heel pain while engaging in weight bearing activity wherein the pad cushions, and reduces sores and pressure off the heel of the sole of the foot by offsetting and cushioning the soft tissue of the outer portions of sole of the heel and offsetting the central portion of the heel from the surface immediately below the pad at a distance of approximately the pad's thickness, during weight bearing activity.

An exemplary embodiment of the present invention provides a pad for relieving foot pain while engaging in weight bearing activity wherein the pad cushions and reduces sores and pressure off the sole of the foot by offsetting the soft tissue of the medial longitudinal arch, thereby supporting the calcaneo-navicular ligament structure reducing over-pronation and increasing supination of the foot during weight bearing activity, offsetting and cushioning the soft tissue of the outer portions of sole of the heel and offsetting the central portion of the heel from the surface immediately below the pad at a distance of approximately the pad's thickness, during weight bearing activity.

An exemplary embodiment of the present invention provides a pad comprising an arch portion of the pad fitting under and adjacent to the medial longitudinal arch of the foot, offsetting the soft tissue of the medial longitudinal arch thereby supporting the calcaneo-navicular ligament structure, wherein the arch portion extends from front to rear, of the longitudinal medial arch, and the arch portion extends from the medial side towards the lateral side, of the longitudinal medial arch, wherein the pad comprises a heel portion of the pad connecting to the arch portion wherein the heel is portion situated under the heel of the foot.

A pad for relieving foot pain, the pad comprising a first plantar surface adapted to face the foot, a second plantar surface adapted to face away from the foot, wherein the pad is adapted to be worn on the left foot when the pad is in a first position and is adapted to be worn on the right foot when the pad is in a second position, thereby providing cushioning and support to the longitudinal medial arch and/or the heel of either foot independently.

Objects, advantages and salient features of the invention will become apparent to those skilled in the art from the following detailed description, which, taken in conjunction with annexed drawings, discloses exemplary embodiments of the invention.

BRIEF DESCRIPTION OF THE DRAWINGS

The above and other exemplary features and advantages of certain exemplary embodiments of the present invention will become more apparent from the following description of certain exemplary embodiments thereof when taken in conjunction with the accompanying drawings in which.

DETAILED DESCRIPTION OF EXEMPLARY EMBODIMENTS

The matters exemplified in this description are provided to assist in a comprehensive understanding of exemplary embodiments of the invention of the present disclosed with reference to the accompanying figures. Accordingly, those of ordinary skill in the art will recognize that various changes and modifications of the exemplary embodiments described herein can be made without departing from the scope and spirit of the claimed invention. Also, descriptions of well-known functions and constructions are omitted for clarity and conciseness.

Figure 1:
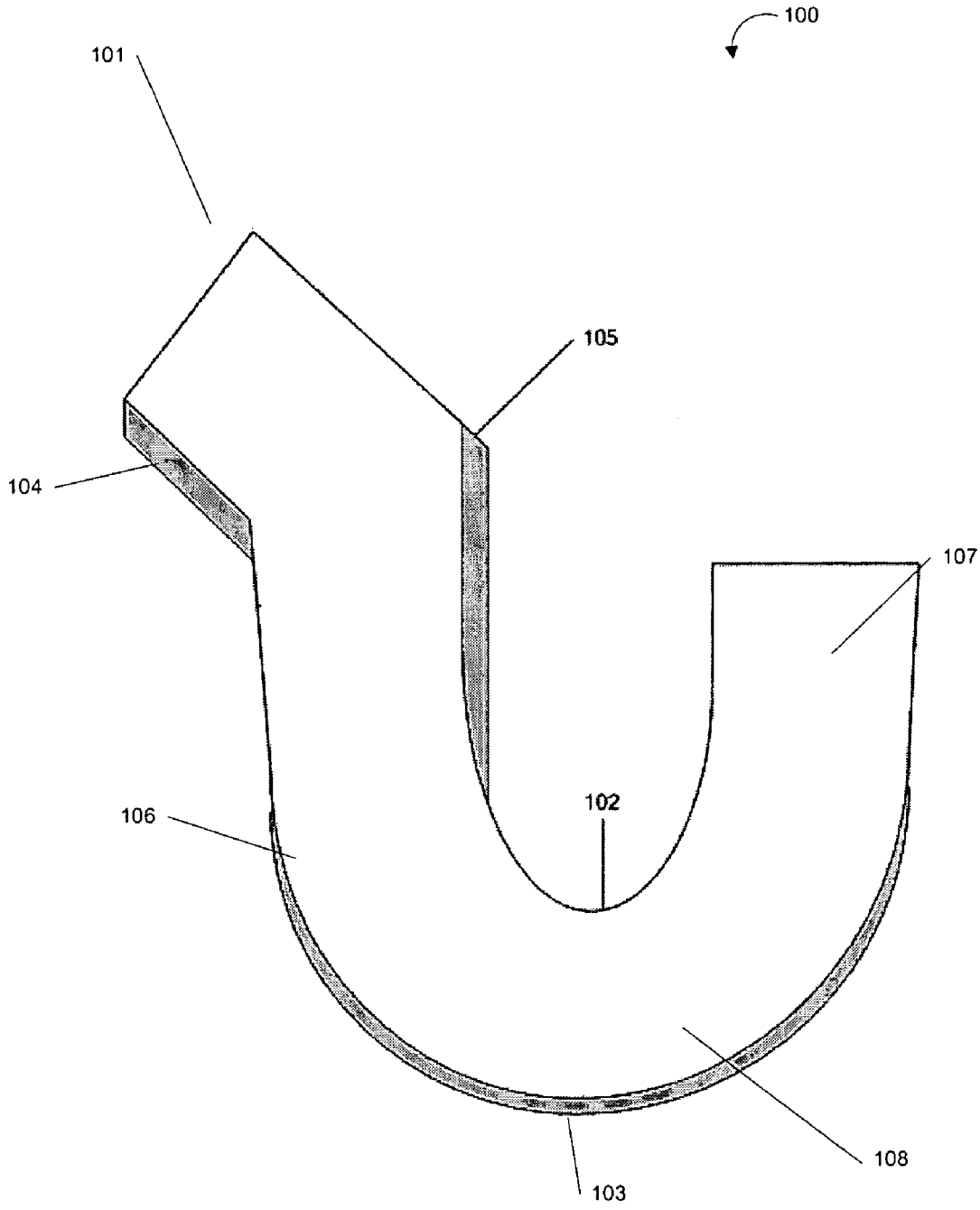
FIGS. 1 and 2 are diagrams illustrating the pad according to exemplary embodiments of the present invention.

FIG. 1 shows the pad 100, according to an exemplary embodiment of the present invention for relieving pain caused by over-pronation of the foot while engaging in weight bearing activity wherein the pad 100 cushions, and reduces sores and pressure off the sole of the foot by offsetting the soft tissue of the medial longitudinal arch, thereby supporting the calcaneo-navicular ligament 302 structure, reducing the over-pronation of the foot and increasing supination during weight bearing activity. Additionally, an exemplary embodiment of the present invention, provides the pad 100 for relieving heel pain while engaging in weight bearing activity wherein the pad 100 cushions, and reduces sores and pressure off the heel of the sole of the foot by offsetting and cushioning the soft tissue of the outer portions of sole of the heel and offsetting the central portion of the heel from the surface immediately below the pad at a distance of approximately the pad's thickness, during weight bearing activity.

Furthermore, a person displaying a high or low arched foot can also experience plantar faciitis. Patients with lower arches have conditions resulting from limited motion. People with different foot types experience plantar fascia pain from different biomechanical stresses. For example, windlass mechanism is a mechanical model that provides an explanation of these biomechanical stresses. Exemplary embodiments of the present invention provide benefits of overcoming stresses relating to "windlass" mechanism, as described in, for example, "Plantar Fasciitis and the Windlass Mechanism: A Biomechanical Link to Clinical Practice", By Lori A Bolga and Terry R. Malone, Journal of Athletic Training, January-March 2004 pages 77-82, 39(1), PMCID:PMC385265, the entire disclosure of which is hereby incorporated by reference, for all that it teaches. Exemplary embodiments of the present invention implement certain features described in this reference, and such features may not be further described in detail in the examples that follow, for clarity and conciseness.

Further, as shown in FIGS. 1, 2, 4 and 6-11, exemplary embodiments of the present invention provide for a pad 100, 200, wherein the pad 100, 200 comprises an arch portion 101 of the pad fitting under and adjacent to the longitudinal medial arch 401 of the foot, offsetting the soft tissue 403 of the medial longitudinal arch 401 and supporting the calcaneo-navicular ligament structure 302, 303, wherein the arch portion 101 extends from front to rear of the longitudinal medial arch 401, and the arch portion 101 extends from the medial side towards the lateral side of the longitudinal medial arch. Certain embodiments of the present invention also comprise, in addition to the arch portion, a heel portion of the pad connecting 106 to the arch portion wherein the heel portion can be situated under the heel of the foot.

FIGS. 1, 2, 5 and 8 show the pad 100, 200, 503, 800, according to an exemplary embodiment of the present invention comprising a heel portion 108 of the pad for relieving heel pain while engaging in weight bearing activity wherein the pad cushions, and reduces sores and pressure off the heel

304, 502 of the sole 303 of the foot by offsetting and cushioning the soft tissue of the outer portions of sole of the heel 306 and offsetting the central portion of the heel 402, 506 from the surface immediately below the pad at a distance of approximately the pad's thickness, during weight bearing activity. Certain embodiments of the present invention also comprise, in addition to the heel portion, an arch portion of the pad fitting under and adjacent to the longitudinal medial arch of a foot, offsetting the soft tissue of the medial longitudinal arch thereby supporting the calcaneo-navicular ligament structure Further, exemplary embodiments of the present invention, as shown in FIGS. 1, 2, 4, 5 and 8, provide for a pad 100, 200, 400, 503, 800 comprising a rear portion 108, 408, 801 that connects a medial side portion 106, 802 to a lateral side portion 107, 803, each having substantially the same width, wherein the rear portion 108, 408, 801 of the pad extends forward towards the front of the foot, and terminates at a front edge 102, 804 situated on a rear side to the central portion of the heel 402.

FIG. 1 shows a pad 100, according to an exemplary embodiment of the present invention, for relieving pain while engaging in weight bearing activity, the pad 100 comprising an arch portion 101 being connected to and making an angle of substantially 45 degrees with said medial side portion, beyond a length of the lateral side portion in a direction away from the lateral side portion and the rear portion, fitting under and adjacent to the longitudinal medial arch of a foot, offsetting the soft tissue of the medial longitudinal arch thereby supporting the calcaneo-navicular ligament structure, and a heel portion 108 of the pad fitting under the heel of the foot, the heel portion 108 connecting a medial side portion of the pad to a lateral side portion of the pad, wherein the pad 100 cushions and reduces soreness and pressure from the sole of the foot by offsetting the soft tissue of the medial longitudinal arch, thereby supporting the calcaneo-navicular ligament structure reducing over-pronation and increasing supination of the foot during weight bearing activity, offsetting and cushioning the soft tissue of the outer portions of sole of the heel and offsetting the central portion of the heel from the surface immediately below the pad at a distance of approximately the thickness of the pad.

Further, exemplary embodiments of the present invention also provide a pad 100 comprising a pliable, flexible, shock-absorbing, compressible material such that the foot is comfortable but the pad is firm enough to retain shape and offset portions of the foot. Exemplary embodiments of the present invention provide a pad that ranges in thickness of ⅛ inch to ½ inch 103, 503. For example, the pad can be comprised of one or more of the following flexible, shock absorbing, compressible materials: low-density sponge, high-density sponge, polyurethane foam, ethyl vinyl acetate, cloth, felt, memory foam, gel, liquid, air and gas.

Further, exemplary embodiments of the present invention also provide for a pad 100 that maintains substantially uniform thickness throughout the pad when the pad is not engaged in weight bearing activity 103, 104 and 105.

Figure 2:
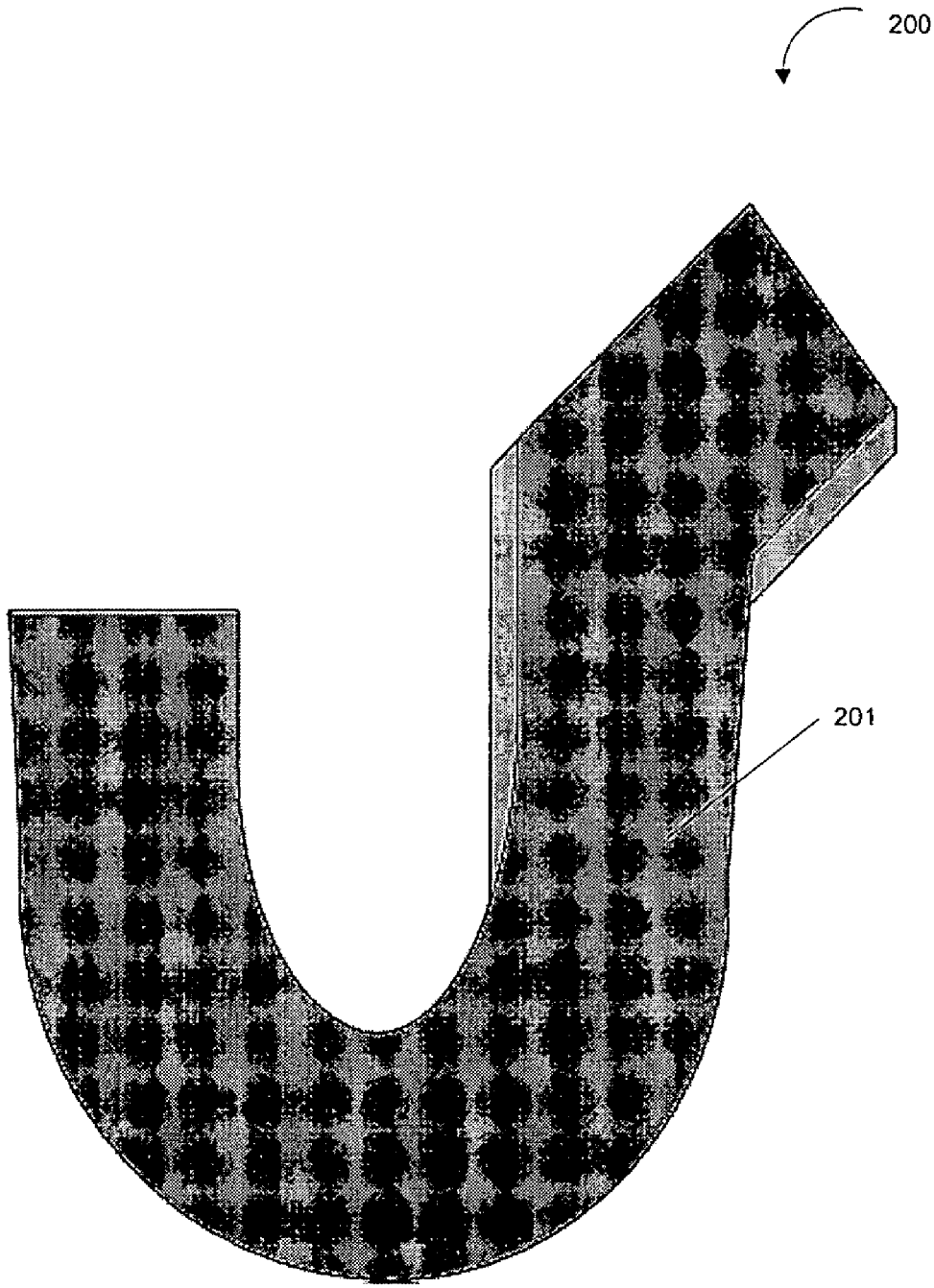
Figure 3:
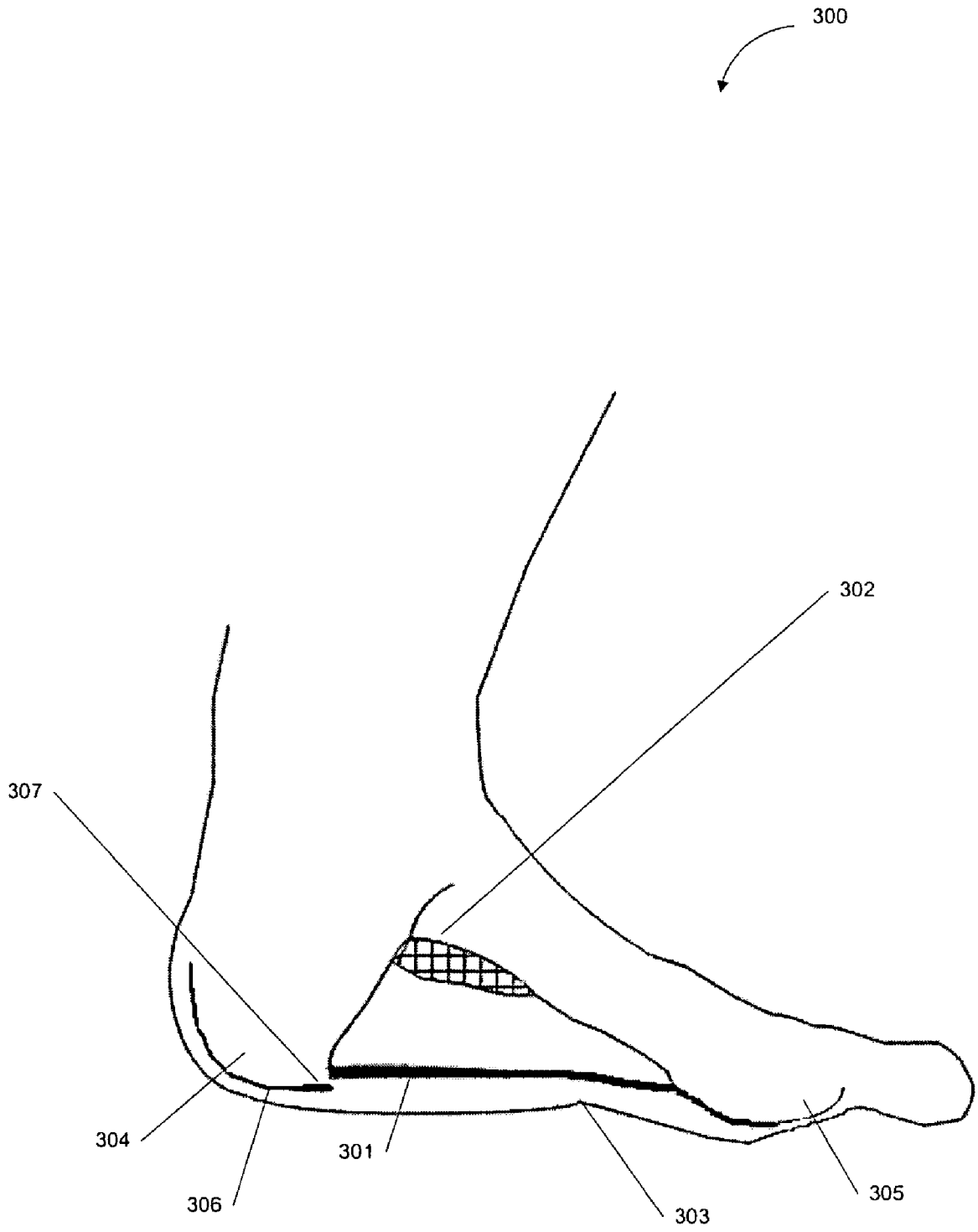
FIG. 3 is a diagram illustrating the portions of a foot relevant to an exemplary embodiment of the present invention.

Further, FIG. 2 shows a pad according to an exemplary embodiment of the present invention where the first and/or the second planar surfaces are coated with an adhesive layer 201.

Further, exemplary embodiments of the present invention also provide for a pad 100, 200 that is designed to be adapted to support either a left or right foot (FIGS. 1, 2 and 6-11). For example, FIG. 2 shows an exemplary pad that would be applied with adhesive side 201 down in shoe (for example, the right shoe), but the same pad can also be applied to the opposite foot (for example, by mounting the adhesive planar surface directly to the left foot without the shoe), according to an exemplary embodiment of the present invention. Further, the adhesive on the surface 201 provides enough adhesion to be removably stuck to the applied surface, such that the pad can be removed with reasonable force by a human being intending to remove the pad from the mounted position. According to an exemplary embodiment, an individual may mount the pad provided in the present application to a bare foot (or a foot covered by a thin material, for example, a sock), thereby providing flexibility to an individual to either use or not use any footwear, according to their desire.

Figure 4:
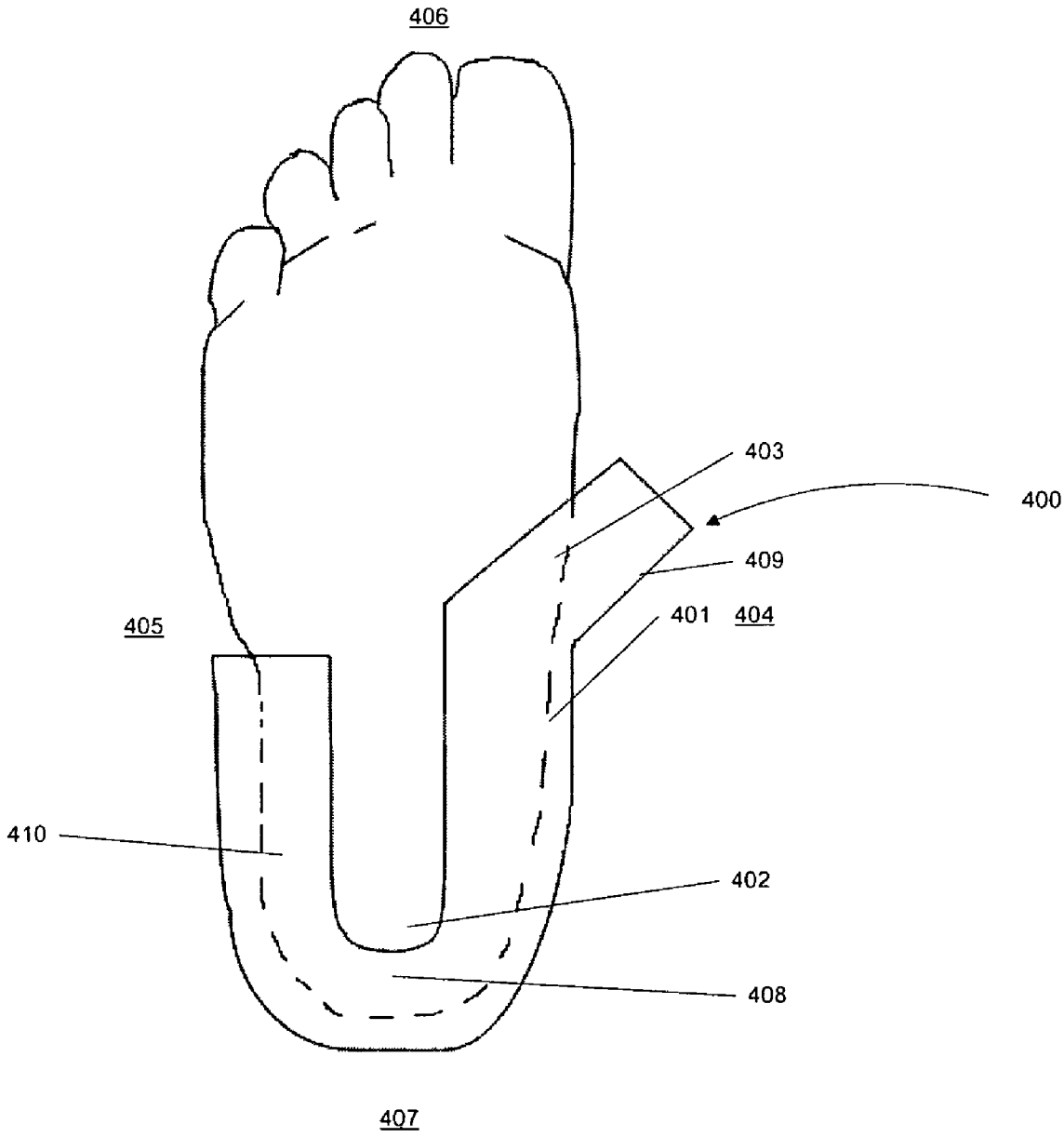
FIG. 4 is a diagram illustrating the pad, according to an exemplary embodiment of the present invention, in relation to a foot, according to an exemplary embodiment of the present invention.

Alternatively, according to an exemplary embodiment of the present invention as shown in FIG. 4, the pad 400 can be applied using any means to secure the pad in place to provide comfort to the medial longitudinal arch 401 and/or the heel 402. For example, the pad can be place inside the lining of, or stitched to any foot apparatus. As another example, the pad can also be taped and/or adhesively mounted to the heel portion such as to keep the pad in place.

Figure 5:
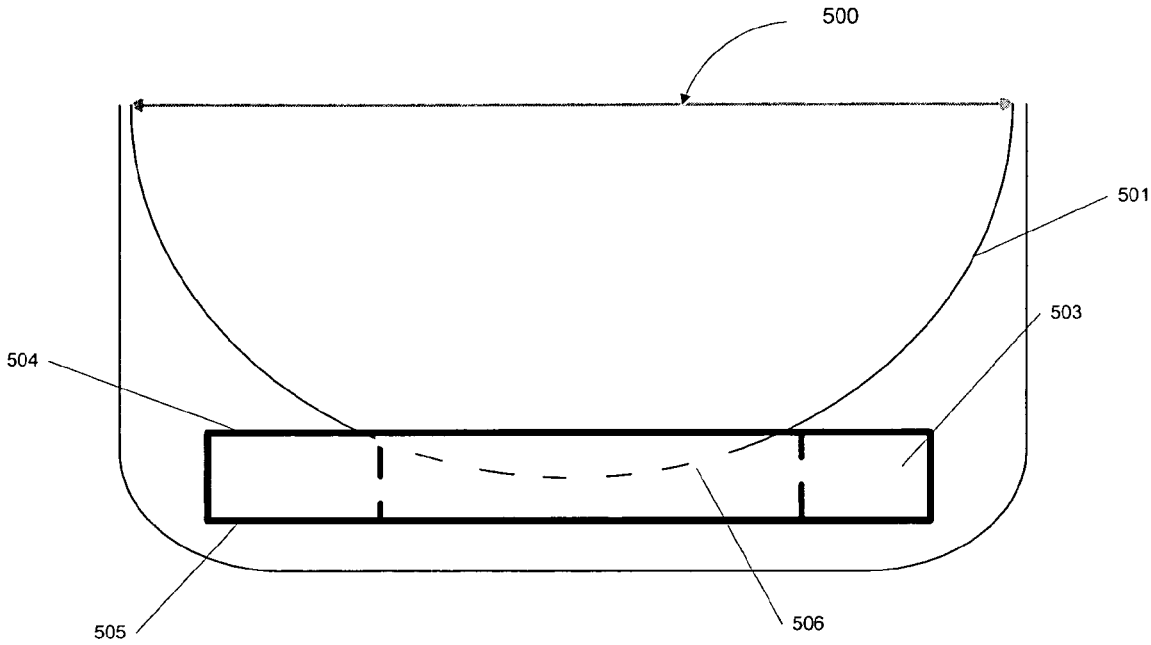
FIG. 5 is a diagram illustrating a rear view of a foot in a shoe with the pad mounted in the shoe, according to an exemplary embodiment of the present invention.

According to an exemplary embodiment of the present invention, as shown in FIG. 5, the pad 503 can be adapted to fit within at least one of an athletic shoe, a running shoe, a tennis shoe, a cross-trainer shoe, a walking shoe, a child's shoe, a work shoe, a dress shoe, a casual shoe, an open-toe shoe, an orthopedic shoe, a sandal, a military shoe, an all-terrain shoe, a diabetic shoe, a specialty shoe, a boot, and/or any other means or apparatus applied to the foot 501.

Further, an exemplary embodiment of the present invention, as shown in FIG. 5 provides for a pad 503 that comprises a first planar surface 504 and a second planar surface 505, wherein the first planar surface 504 is adapted to face the foot, and the second planar surface 505 is adapted to face away from the foot, during application of the pad 503. According to exemplary embodiments, the pad 500 can be applied to the opposite foot by simply turning the pad over so that first planar surface and the second planar surface have switched directions such that the second planar surface faces the foot and the first planar surface faces away from the foot. This exemplary embodiment of the present invention provides a significant benefit over prior art to individuals by allowing for the flexibility of a pad that can be adapted with or without a shoe, a sock, or any other means or apparatus applied to either foot. Specifically, an exemplary embodiment of the present invention provides a pad that can easily be used on either left or right foot, individually, depending on the individual's desire.

FIG. 4 shows the pad 400, according to exemplary embodiments of the present invention comprising an arch portion 409 of the pad fitting under and side of the medial longitudinal arch 401 of the foot, offsetting the soft tissue 403 of the medial longitudinal arch thereby supporting the calcaneo-navicular ligament 302 structure, wherein the arch portion 409 extends from front to rear, of the medial longitudinal arch 401, and the arch portion 409 extends from the medial side towards the lateral side of the medial longitudinal arch.

Figure 6:
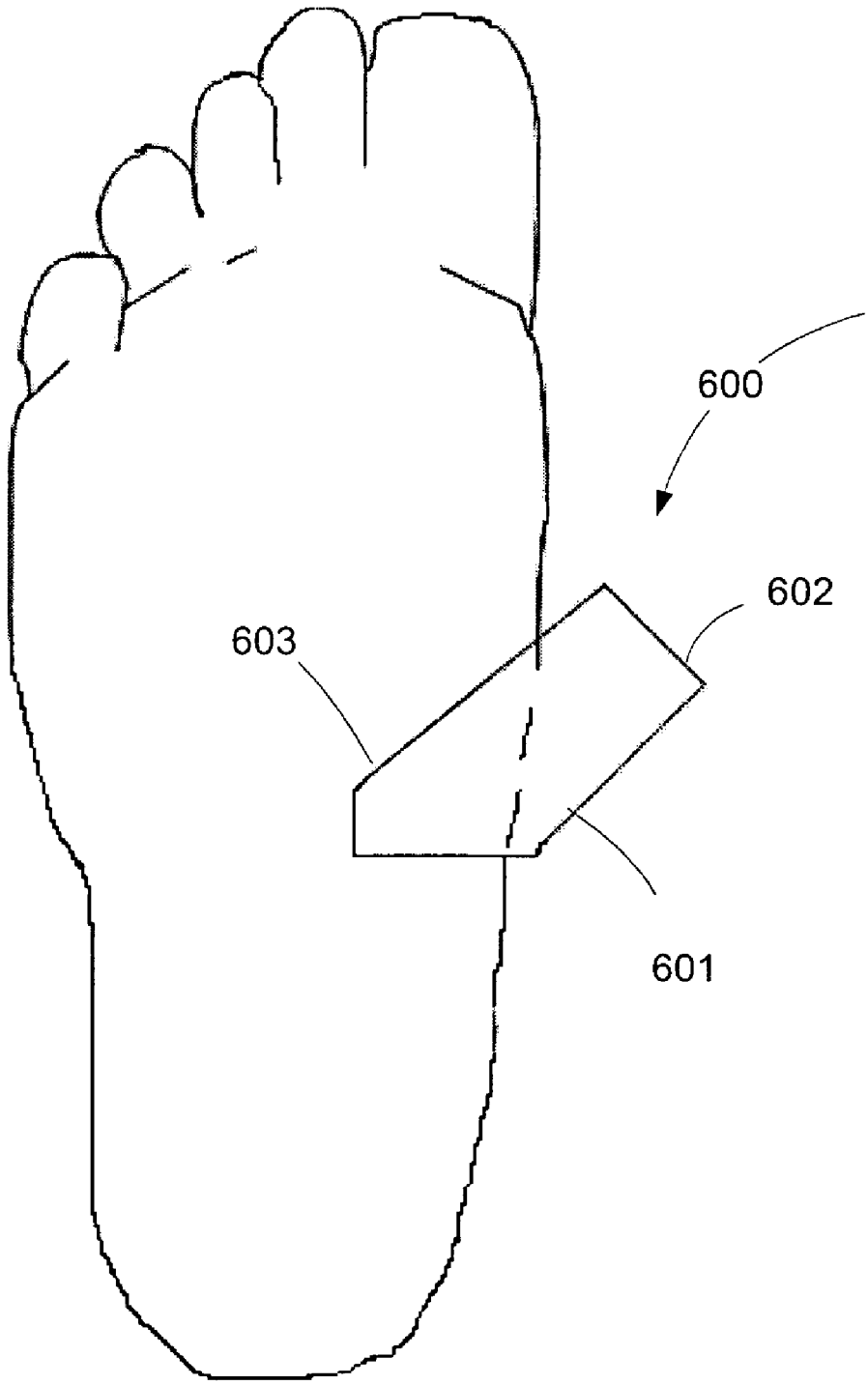
FIGS. 6-11 are diagrams illustrating a pad according to exemplary embodiments of the present invention Throughout the drawings, like reference numerals will be understood to refer to like elements, features and structures.
Figure 7:
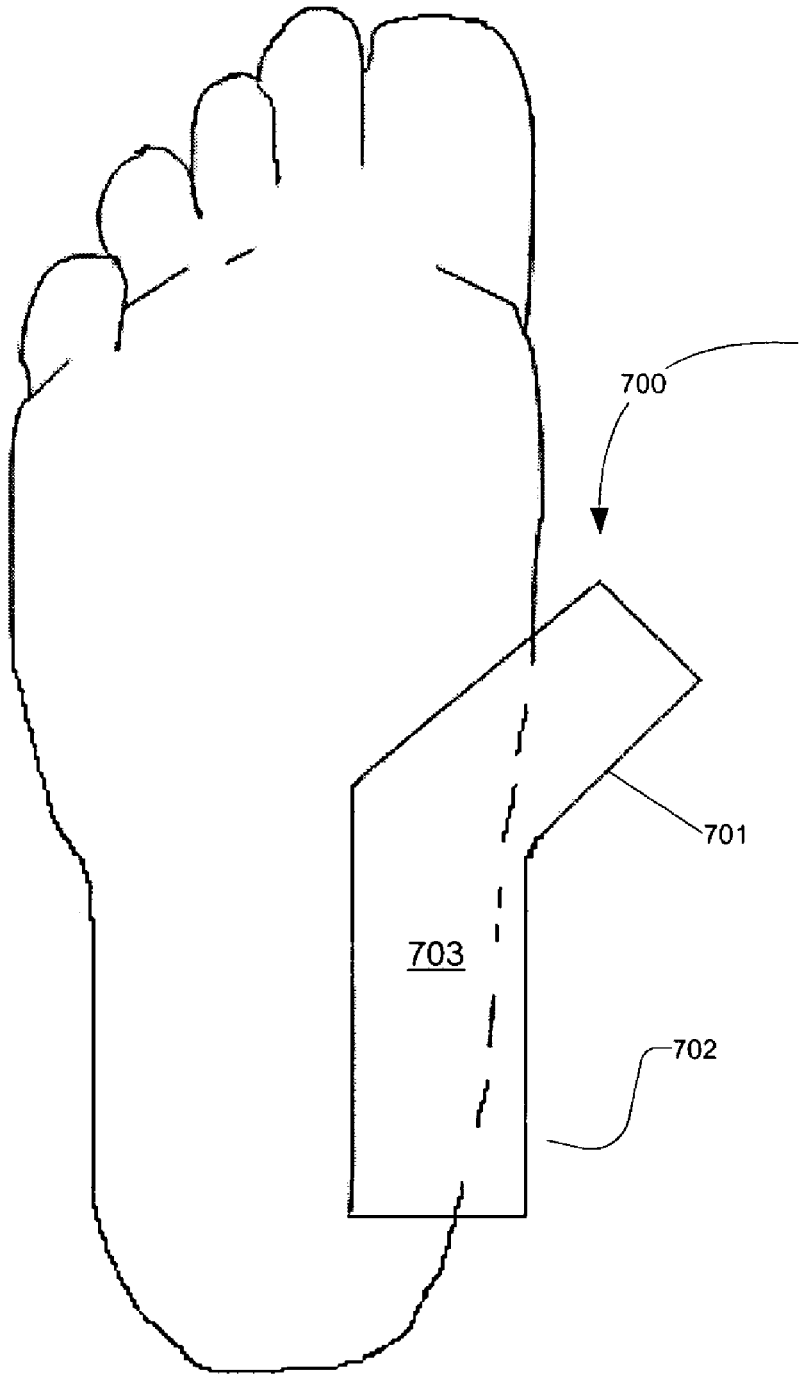
Figure 8:
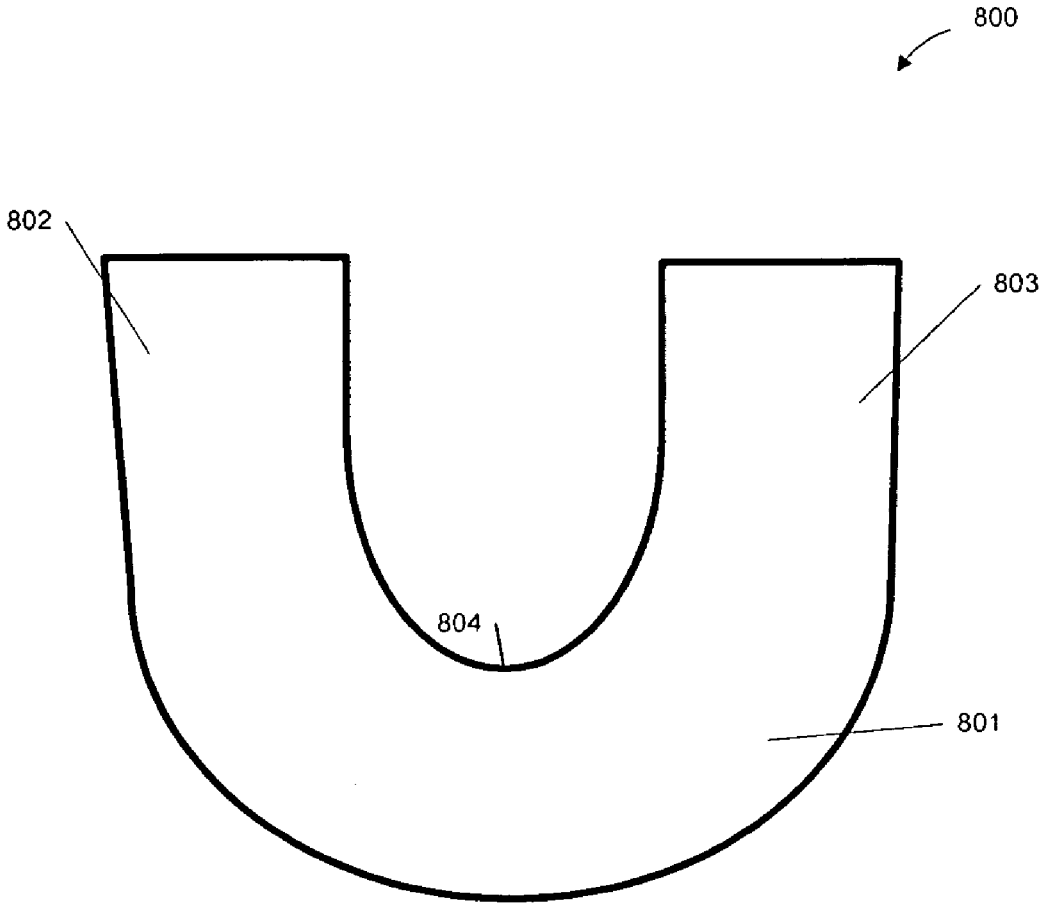

FIG. 6 shows the pad 600, according to exemplary embodiments of the present invention comprising an arch portion 601 of the pad fitting under and side of the medial longitudinal arch of the foot, offsetting the soft tissue of the medial longitudinal arch thereby supporting the calcaneo-navicular ligament 302 structure, wherein the arch portion 601 extends from front to rear, of the medial longitudinal arch, and the arch portion 601 extends from the medial side towards the lateral side of the medial longitudinal arch.

FIGS. 7 and 9-11 show a pad 700, 900, 1000, 1100, according to exemplary embodiments of the present invention comprising a heel portion 702, 902, 1002, 1102 of the pad connecting to the arch portion 701, 901, 1001, 1101 wherein the heel portion is situated under the heel 304 of the foot.

Further, exemplary embodiments of the present invention, as show in FIGS. 7-11, provide a pad 700, 800, 900, 1000, 1100 wherein the heel portion 702, 801, 902, 1002, 1102 comprises a medial side portion 703, 803, 903, 1003, 1103 of the pad supporting the medial side of the heel.

Further, exemplary embodiments of the present invention, as shown in FIGS. 8-11, provide a pad 800, 900, 1000, 1100 wherein the heel portion 801, 902, 1002, 1102 comprises a lateral side portion 802, 904, 1004, 1104 of the pad that connects to the medial side portion 803, 903, 1003, 1103 of the pad, respectively, supporting the lateral side of the heel.

Figure 9:
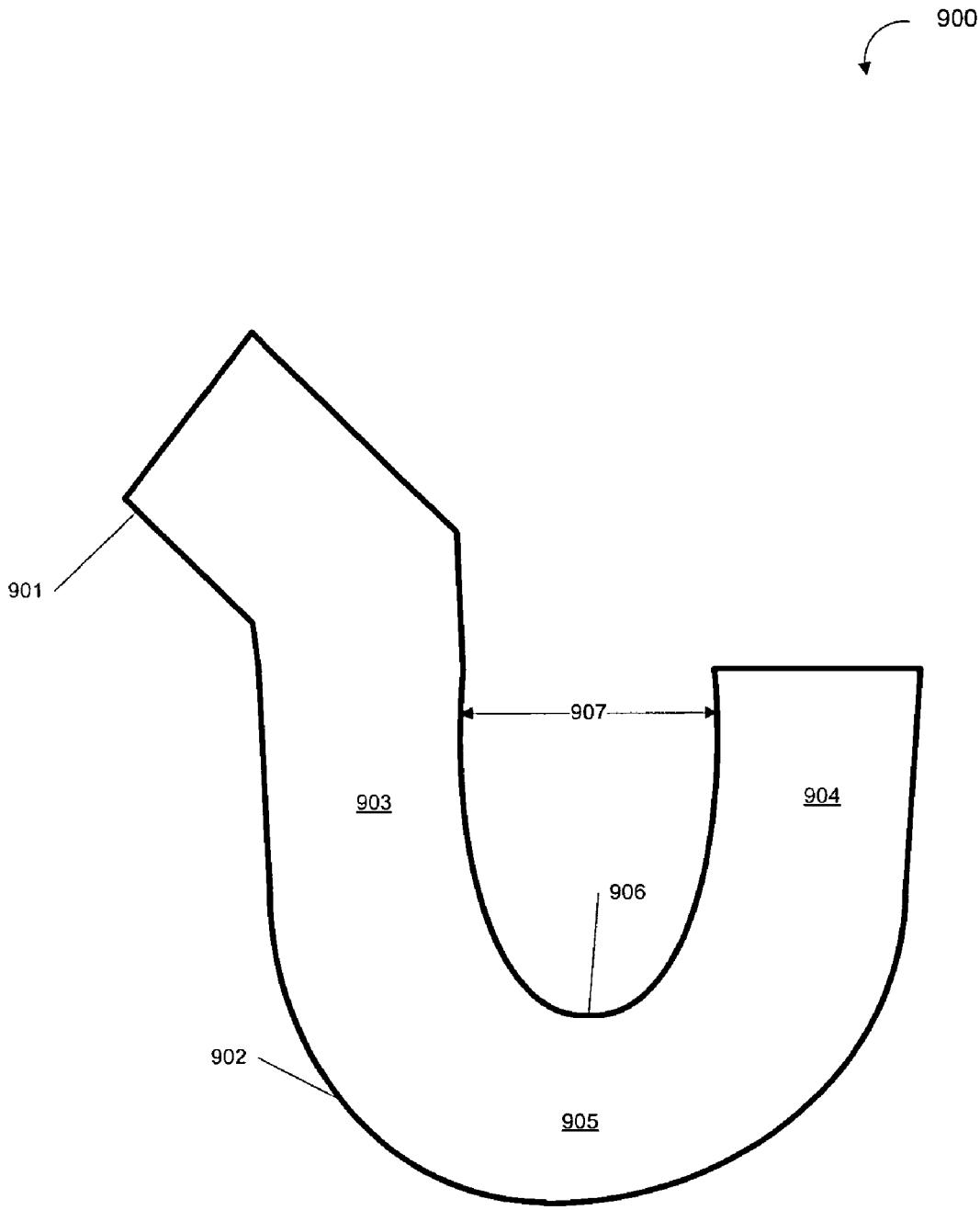
Figure 10:
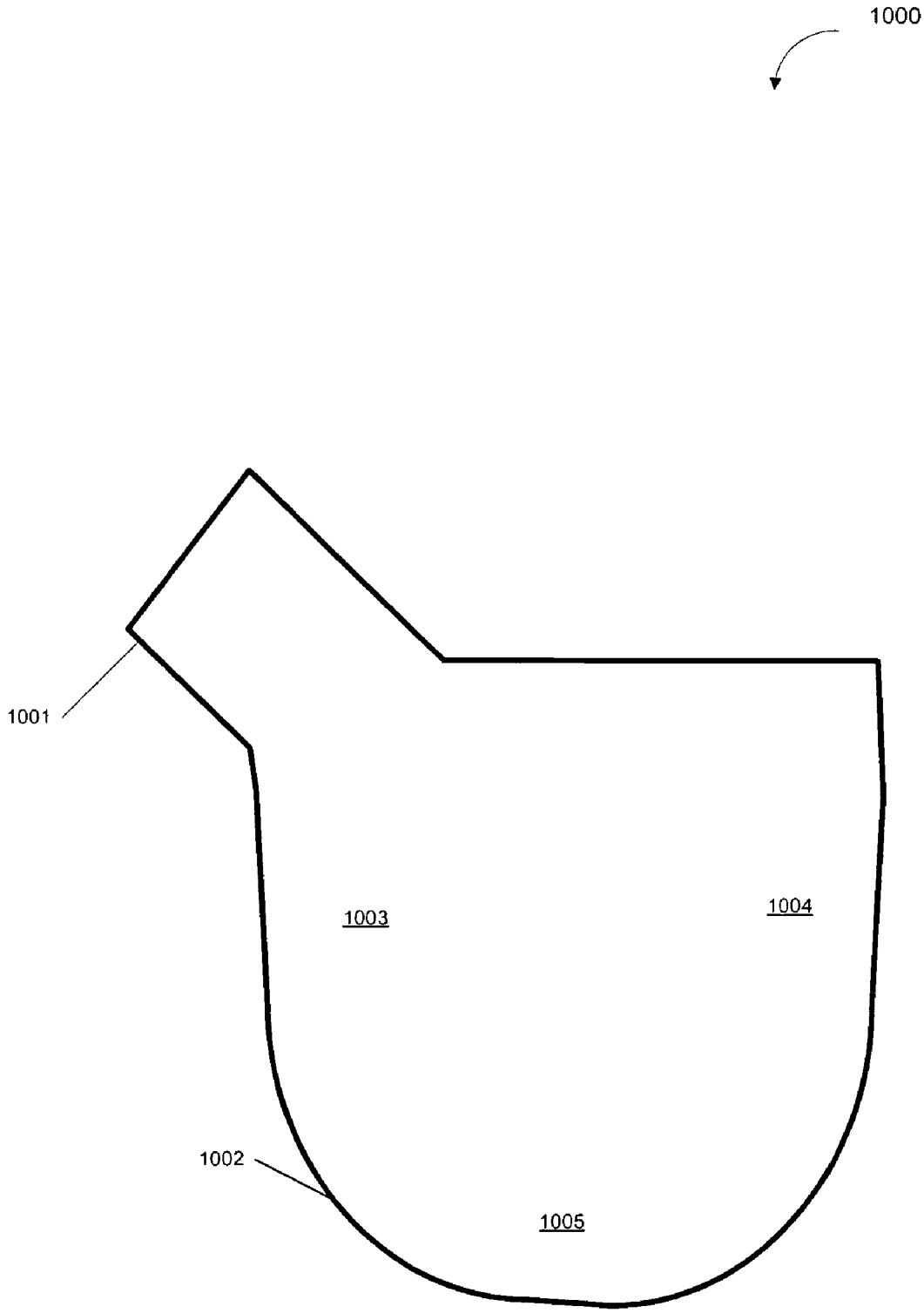
Figure 11:
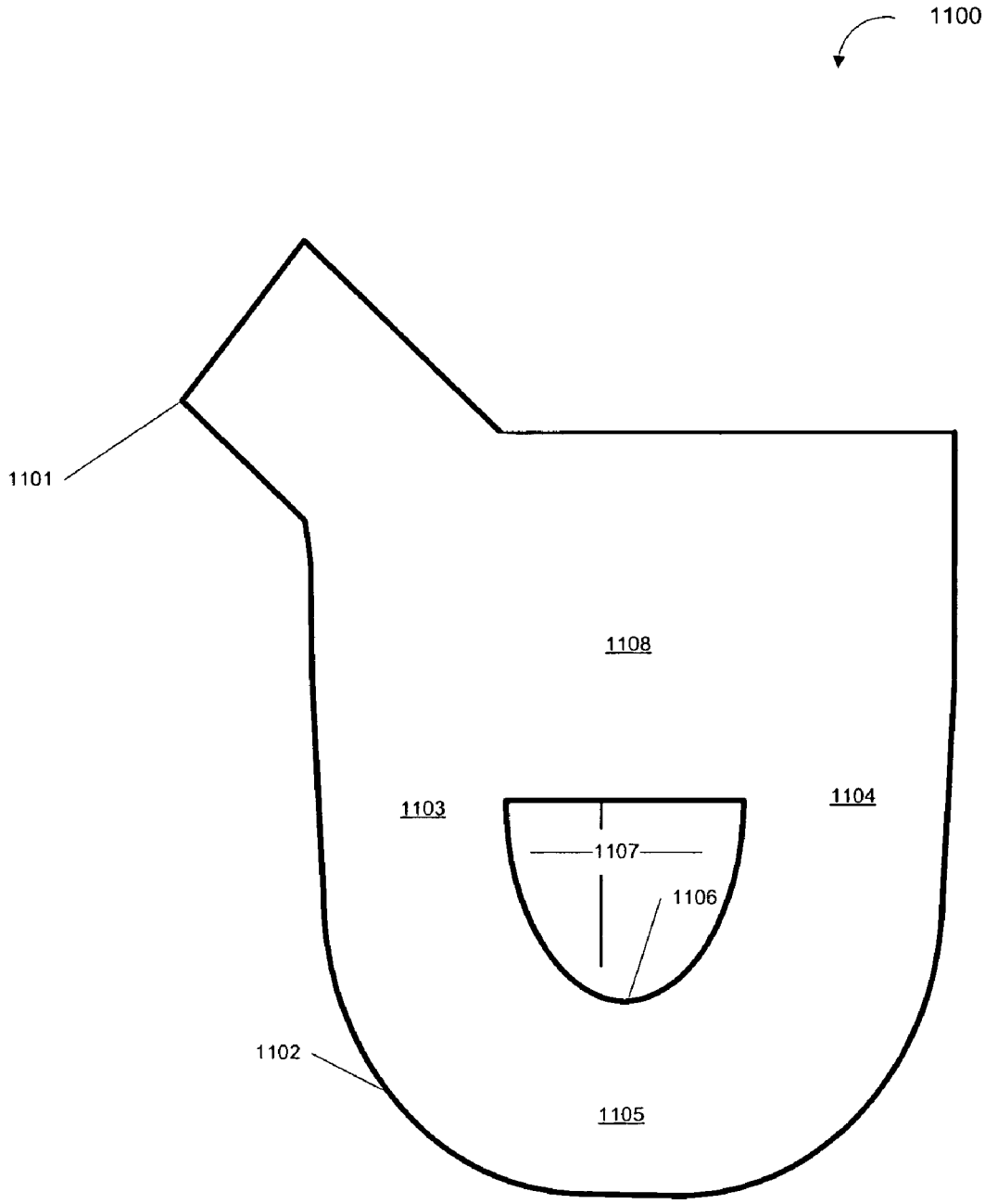

Further, exemplary embodiments of the present invention, as shown in FIGS. 9 and 11, provide for a pad 900, 1100 comprising a rear portion of the pad 905, 1105 that connects the medial side portion of the pad to the lateral side portion of the pad, wherein the rear portion of the pad extends forward towards the front of the foot and terminates at a front edge 906, 1106 situated on a rear side to the central portion of the heel, thus creating a space 907 1107 under the central portion of the heel in front of the forward edge of the rear portion of the pad, wherein the space is flanked by the medial side 903, 1103 and the lateral side 904 1104 of the pad, respectively, for offsetting the central portion of the heel from the surface immediately below the pad, creating a U-shaped, V-shaped or an O-shaped appearance in certain embodiments. In addition, according to another exemplary embodiment of the present invention, the pad comprises a front portion 1108 that connects the medial side portion of the pad to the lateral side portion of the pad, wherein the front portion of the pad is situated starting approximately from the middle of the foot extending to terminate at the front side of the heel, thus creating a space in the pad (for example, a hole 1107) under the central portion of the heel, according to certain exemplary embodiments.

According to exemplary embodiments of the present invention, the pad can be adapted to fit any foot size. The pad can either be provided in pre-determined sizes (for example, small, medium, or large) or be custom designed to fit any foot size and/or shape.

While the present invention has been shown and described with reference to particular illustrative embodiments, it is not to be restricted by the exemplary embodiments but only by the appended claims and their equivalent. It is to be appreciated that those skilled in the art can change or modify the exemplary embodiments without departing from and the scope and spirit of the present invention.

What is claimed is:

1. A pad for relieving pain, the pad comprising:

a substantially U-shaped heel portion including a lateral side portion, a medial side portion, and a rear portion, each having substantially the same width, said rear portion being disposed at a base of said heel portion and being connected between said lateral side portion and said medial side portion and extending along the width to a front edge that creates a substantially U-shaped space flanked on either side by the lateral side portion and the medial side portion, said medial side portion being connected to said rear portion at one end thereof and connected to an arch portion at an opposite end, and extending along the width from a medial outer side edge to a medial inner side edge, said lateral side portion being connected to said rear portion at one end thereof and terminating at an opposite end, and extending along the width from a lateral outer side edge to a lateral inner side edge, said arch portion connected to, and making an angle of substantially 45 degrees with said medial side portion, beyond a length of said lateral side portion in a direction away from said lateral side portion and said rear portion, wherein, a first planar surface is disposed on a top side of said heel portion and said arch portion, and a second planar surface is disposed on a bottom side of said heel portion and said arch portion.

2. The pad recited in claim 1, wherein said first planar surface is disposed to face a foot; and said second planar surface is disposed to face a shoe.

3. The pad recited in claim 1, wherein the pad is designed to be adapted to support either a left or right foot.

4. The pad recited in claim 1, wherein the pad comprises flexible, shock-absorbing, compressible material such that the pad is firm enough to retain its shape and offset portions of the foot and the pad ranges in thickness of ⅛ inch to ½ inch.

5. The pad recited in claim 1, wherein one or more said first and second planar surfaces are coated with an adhesive layer.

6. The pad recited in claim 1, wherein when said pad is disposed in a shoe under a foot, said heel portion is disposed under a heel of said foot, and said arch portion is disposed on a bottom inside surface of said shoe and a side surface of said shoe along an entire length and width of a longitudinal medial arch of said foot.

7. The pad recited in claim 1, wherein said heel portion and said arch portion are made of a pliable material having the same uniform thickness.

* * * * *